US008074796B1

(12) United States Patent
Andrews

(10) Patent No.: US 8,074,796 B1
(45) Date of Patent: Dec. 13, 2011

(54) BRUSH HOLDER

(75) Inventor: Tim Andrews, Suwanee, GA (US)

(73) Assignee: Paint Tool Protection Products, Inc., Atlanta, GA (US)

( * ) Notice: Subject to any disclaimer, the term of this patent is extended or adjusted under 35 U.S.C. 154(b) by 750 days.

(21) Appl. No.: 11/712,865

(22) Filed: Mar. 1, 2007

(51) Int. Cl.
*B65D 75/14* (2006.01)

(52) U.S. Cl. ..... 206/361; 206/15.3; 206/565

(58) Field of Classification Search ..... 206/361, 206/362.2, 362.3, 15.3, 362.4, 561, 565, 206/1.5, 349, 372, 373, 378, 379; 220/4.22, 220/4.23, 4.24
See application file for complete search history.

(56) References Cited

U.S. PATENT DOCUMENTS

| | | | | |
|---|---|---|---|---|
| 1,437,822 | A | | 12/1922 | Seymour |
| 1,869,753 | A | | 8/1932 | Kamm |
| 1,872,827 | A | | 8/1932 | Searles |
| 1,951,576 | A | | 3/1934 | Lehr |
| 2,004,320 | A | | 6/1935 | Hanson |
| 2,051,267 | A | | 8/1936 | Mezey |
| 2,610,731 | A | | 9/1952 | Austin |
| 3,000,491 | A | | 9/1961 | McIntosh |
| 3,800,998 | A | | 4/1974 | Gask |
| 4,423,811 | A | | 1/1984 | Knapp |
| 4,606,456 | A | * | 8/1986 | Kaminski ..... 206/362.4 |
| 5,076,460 | A | * | 12/1991 | Hussell ..... 220/4.22 |
| 5,191,973 | A | * | 3/1993 | Shteynberg ..... 206/15.2 |
| 5,244,090 | A | | 9/1993 | Keith |
| 5,645,167 | A | | 7/1997 | Conrad |
| 5,855,274 | A | * | 1/1999 | Piao ..... 206/373 |
| D425,708 | S | | 5/2000 | Drees et al. |
| 6,199,694 | B1 | | 3/2001 | Van Diest et al. |
| 6,338,406 | B1 | | 1/2002 | Zagar |
| 6,390,430 | B1 | * | 5/2002 | Hawley et al. ..... 248/311.2 |
| 6,752,267 | B2 | | 6/2004 | MacPherson et al. |
| 2004/0050732 | A1 | | 3/2004 | Baker |

* cited by examiner

*Primary Examiner* — J. Gregory Pickett
*Assistant Examiner* — King M Chu
(74) *Attorney, Agent, or Firm* — Baker Donelson et al.; Dorian B. Kennedy

(57) ABSTRACT

A paint brush container (10) is disclosed which includes has a base (11) and a lid (12) pivotally coupled to the base through an elongated hinge (13). The base has a bottom wall (15) with a linear array of first mounting holes (22) and second mounting holes (23). The base also includes a brush handle holder (24) and two laterally spaced, removably mounted restricting walls (26) which include a pair of mounting posts (27) configured to be releaseable received within the first and second mounting holes (22) and (23). The brush container also includes a pair of latches (41) which enable the lid to be releaseably held to base.

6 Claims, 3 Drawing Sheets

BRUSH HOLDER

This invention relates to containers, and specifically to containers utilized to hold paint brushes.

BACKGROUND OF THE INVENTION

In the painting industry, painters typically rely on expensive paint brushes. Professional painters desire a paint brush that provides excellent coverage, durability, precise lines, proven results for smooth finishes, and a lack of bristles or filaments left within the paint. When a paint brush no longer fulfills these desired qualities, they are discarded and a new paint brush is purchased.

To prolong the life of a paintbrush a painter must clean the brush in an appropriate solution to remove all of the remaining paint from the brush. After the paint brush has been cleaned, the bristles tend to separate or splay, this condition may be referred to as "brooming". This becomes a problem when the painter subsequently uses the paint brush since the edges of the brush are not uniformly aligned and thereby results in the paint being applied unevenly.

Therefore, a need existed to provide a paint brush container that can prevent the splaying of the bristles after cleaning. Accordingly, it is to the provision of such that the present invention is primarily directed.

DETAILED DESCRIPTION

Figure 1:
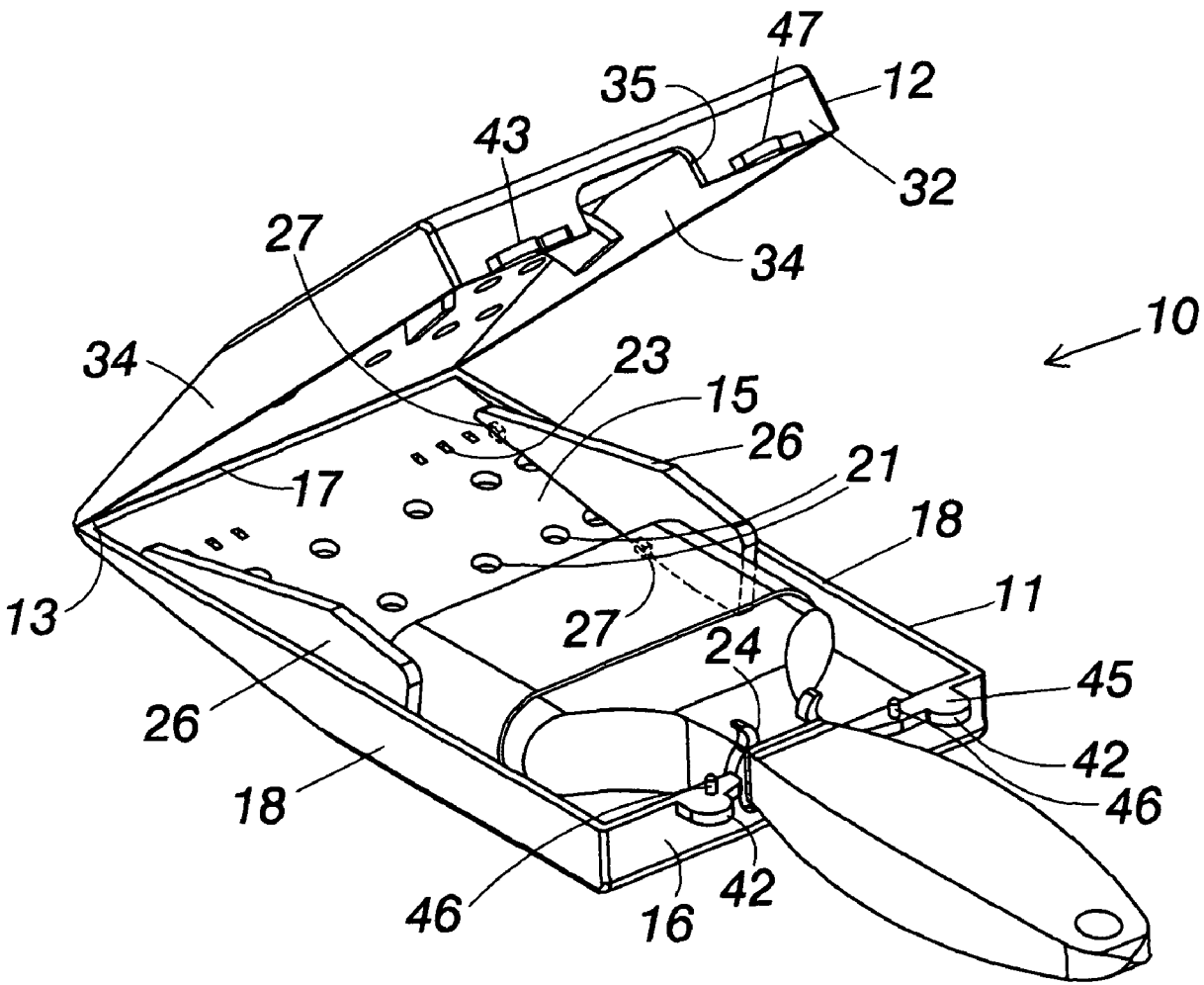
FIG. 1 is a perspective view of a brush container in a preferred form of the invention, shown in an open configuration holding a paint brush with the bristles removed for clarity.
Figure 2:
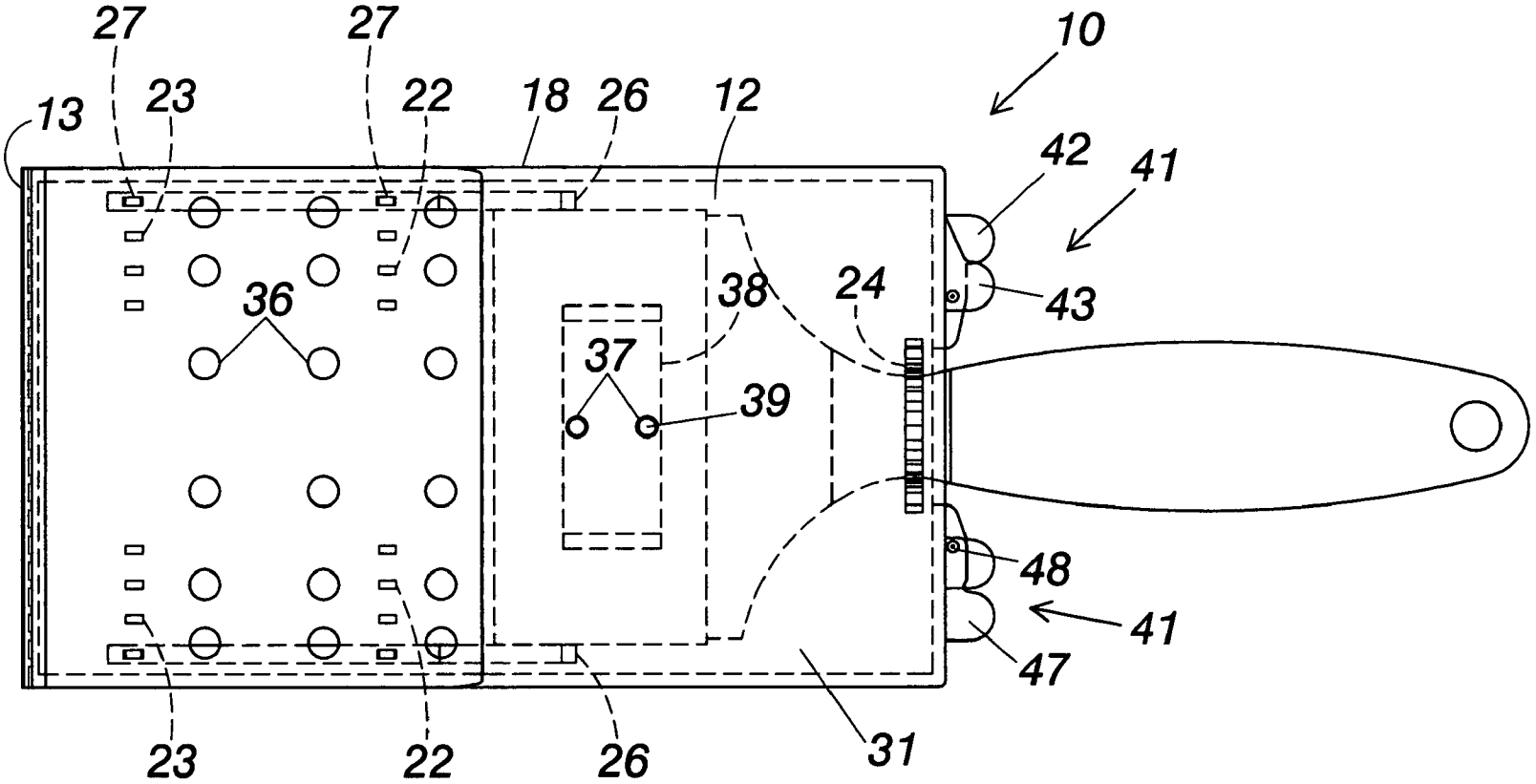
FIG. 2 is a top view of the brush container of FIG. 1.
Figure 3:
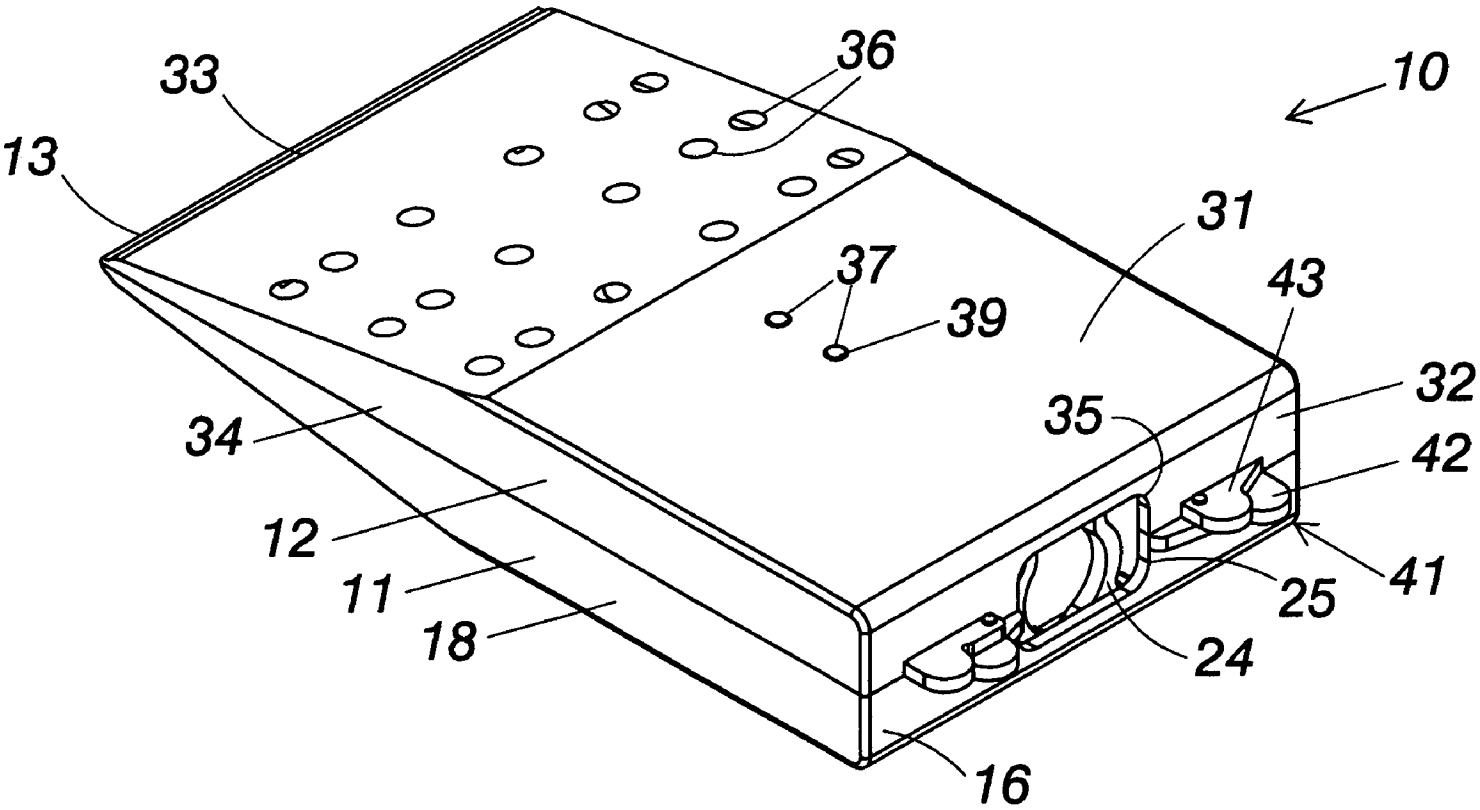
FIG. 3 is a perspective view of the brush container of FIG. 1.

With reference next to the drawings, there is shown a brush container or case 10 in a preferred form of the invention. The brush container 10 has a tapered first case member, housing portion, or base 11 and a tapered second case member, housing portion, or lid 12 pivotally coupled to the base 11 through an elongated hinge 13 which enables the lid to be moved between an open configuration and a closed configuration. The container is adapted to hold a conventional paint brush PB which includes an elongated handle H, a ferule F, and a mass of bristles B.

The base 11 is generally rectangular in shape having a partially angled bottom wall 15, a front end wall 16, a rear edge 17 extending to hinge 13, and a pair of side walls 18. The bottom wall 15 has a plurality of drain holes 21, a linear array of rectangular first mounting holes 22, and a linear array of rectangular second mounting holes 23. The base 11 also includes a removable, resilient horseshoe shaped brush handle holder 24, which is configured to receive and releaseably hold a paint brush handle H therein. The front end wall 16 has a cut-out 25 positioned adjacent the handle holder 24. Lastly, the base includes two laterally spaced, removably mounted restricting walls 26. The restricting walls 26 are tapered to conform with the tapered shape of the base 11 and lid 12 and include a pair of mounting posts 27 configured to be releaseably received within one set of the first and second mounting holes 22 and 23.

The lid 12 is generally rectangular in shape having a partially angled top wall 31, a front end wall 32, a rear edge 33 extending to hinge 13, and a pair of side walls 34. The front end wall 32 has a cut-out 35 which is generally alignable with base cut-out 25. The top wall 31 has a plurality of drain holes 36 and a pair or round mounting holes 37. The lid 12 also includes a removable, resilient U-shaped brush stabilizer 38, which acts as a spring against the brush ferule F of a paint brush PB mounted within the holder. The brush stabilizer 38 has a pair of mounting posts 39 configured to be releaseable mounted within lid mounting holes 37.

The brush container also includes a pair of latches 41 which enable the lid 12 to be releasably held to base 11, i.e., which maintains the container 10 in a closed configuration. Each latch 41 has a first part 42 extending from the base front end wall 16 and a second part 43 extending from the lid front end wall 32. The first part 42 has a grasping flange 45 and a coupling post 46 extending from the grasping flange 45. The second part 43 has a grasping flange 47 and a post hole 48 configured to releaseably hold coupling post 46. It should be understood that any conventionally know type of latch may be utilized as an alternative to the latch described herein.

In use, a conventional paint brush PB is stored within the brush container 10 by pressing the paint brush handle H into holder 24, the resiliency of the holder 24 releasably holding the paint brush yet allowing its easy removal with manual force. The restricting walls 9 are positioned so that they abut the opposite sides of the paint brush ferule F and the opposite sides of the mass of bristles B. The restricting walls 9 are positioned in the proper position to accomplish this task by simply placing their mounting posts 27 within the properly spaced first and second mounting holes 22 and 23. The spacing between the restricting walls 26 prevents the bristles B from spreading or splaying while the brush is stored, thereby retaining the proper shape of the bristles and prolonging the life of the paint brush.

Once the paint brush PB is properly positioned the lid 12 is moved to a closed position with the handle H extending through an opening in the container provide by cut-outs 25 and 35. The container is maintained in a closed configuration by latches 41, whereby the first part coupling posts 46 are positioned within the second part post holes 48. The brush stabilizer 38 contacts the brush ferule F and biases the brush towards the base 11 to help stabilize the brush within the container.

To open the container, an operator merely presses upon the first part grasping flanges 45 and second part grasping flanges 47 in opposite direction, thereby overcoming the frictional force between the coupling posts 46 and post holes 48.

It should be understood that the container 10 may accommodate brushes of various width by simply placing the restricting walls 26 in the appropriate mounting holes 22 and 23. For instance, should a two inch paint brush be stowed within the container the restricting walls 26 are positioned within mounting holes to provide a two inch spacing or distance therebetween. However, should a three inch brush be stowed thereafter, the restricting walls are simply moved laterally to mounting holes providing a three inch space or distance therebetween. As such, one container may be utilized with brushes of several different sizes by simply moving the restricting walls to provide the appropriate distance therebetween.

The stabilizer 38 and brush handle holder 24 are removable from the housing to provide a greater degree of versatility. These components may be stowed within the housing between the brush and the housing.

It should be understood that the restricting wall mounting holes 22 and 23 may be of any shape and are not limited to the rectangular shape shown in the preferred embodiment. It should also be understood that the restricting walls 26 may be spring biased so that they automatically move the proper position abutting the sides of the paint brush or may be mounted on tracks or slots so that the restricting walls are able to slide to the proper position rather than being remounted. It should also be understood that the container may be designed with only one movable restricting wall and a stationary wall, however, the present embodiment is preferred in order to provide a central mounting of the brush within the container. Nevertheless, the stationary wall may be incorporated into one of the side walls of the housing. Lastly, it should be understood that the hinge is optional, but provides enhanced safety as the two housing portion are maintained together to prevent the loss of one portion and ease in the closing of the housing.

The brush container 10 is preferably made of a polypropylene material, however, the invention is not limited to such as other conventionally known materials such as other plastics, metals, paper products or wood may be utilized to construct the present invention.

It thus is seen that a paint brush container is now provided that provides a manner to store paint brushes so that the bristles do not splay. It should be understood that many modifications may be made to the specific preferred embodiment described herein, in addition to those specifically recited, without departure from the spirit and scope of the invention as described by the following

The invention claimed is:

1. A combination paint brush and brush container comprising:

a paint brush having a handle, a ferule, and a mass of bristles, said mass of bristles having a selected width;

a first exterior housing portion having a plurality of liquid drain holes extending therethrough and a plurality of mounting holes extending therethrough;

a second exterior housing portion coupled to said first housing portion for movement between an open configuration and a closed configuration; and a pair of restricting walls, each said restricting wall having at least one mounting post configured to be removably received within one said first exterior housing portion mounting hole, said restricting walls being spaced from each other a select distance generally equal to that of said width of said mass of bristles, whereby the restricting walls may be positioned to abut the bristles of a brush contained within the container and the first exterior housing portion drain holes allow liquids to drain from the interior of said container.

2. The combination paint brush and brush container of claim 1 further comprising a handle holder coupled to said first housing portion and configured to releaseably hold a paint brush handle therein.

3. The combination paint brush and brush container of claim 1 further comprising a latch which releaseably coupled said first housing portion and said second housing portion.

4. The combination paint brush and brush container of claim 1 further comprising a brush stabilizer coupled to said second housing portion and configured to abut a paint brush positioned within said paint brush container, whereby the abutment of the stabilizer against the brush restricts movement of the brush within the container.

5. The combination paint brush and brush container of claim 3 further comprising a brush stabilizer coupled to said second housing portion and configured to abut a paint brush positioned within said paint brush container, whereby the abutment of the stabilizer against the brush restricts movement of the brush within the container.

6. The combination paint brush and paint brush container of claim 1 wherein said first and second exterior housing portions are tapered in an area abutting said paint brush mass of bristles, and wherein each said restricting wall is tapered to conform with said tapering of said first and second exterior housing portions.

* * * * *